US005306168A

United States Patent [19]

Kunishi et al.

[11] Patent Number: 5,306,168

[45] Date of Patent: Apr. 26, 1994

[54] FLOATING TYPE ELECTRIC CONNECTOR

[75] Inventors: Shinsuke Kunishi, Oosaka; Masashi Seto, Zama, both of Japan

[73] Assignee: Molex Incorporated, Lisle, Ill.

[21] Appl. No.: 73,813

[22] Filed: Jun. 8, 1993

[30] Foreign Application Priority Data

Jul. 16, 1992 [JP] Japan ..... 4-212046

[51] Int. Cl.[5] ..... H01R 13/629

[52] U.S. Cl. ..... 439/248

[58] Field of Search ..... 439/246-252

[56] References Cited

U.S. PATENT DOCUMENTS

| | | | |
|---|---|---|---|
| 4,722,691 | 2/1988 | Gladd et al. | 439/79 |
| 4,738,631 | 4/1988 | Takahashi et al. | 439/248 |
| 4,810,215 | 3/1989 | Kaneko | 439/845 |
| 4,998,889 | 3/1991 | Moly | 439/248 |
| 5,112,235 | 5/1992 | Enomoto et al. | 439/83 |
| 5,122,066 | 6/1992 | Plossmer | 439/78 |
| 5,201,663 | 4/1993 | Kikuchi | 439/248 |
| 5,259,779 | 11/1993 | Ooya et al. | 439/247 |

FOREIGN PATENT DOCUMENTS

| | | | |
|---|---|---|---|
| 17940 | 10/1980 | European Pat. Off. | 439/248 |
| 519264 | 12/1992 | European Pat. Off. . | |
| 2-106882 | 4/1990 | Japan . | |

*Primary Examiner*—Gary F. Paumen

*Attorney, Agent, or Firm*—Stephen Z. Weiss

[57] ABSTRACT

A floating type electric connector adapted to be mounted on a circuit board comprising a housing having an integrally formed movable housing portion, a stationary housing portion, and a resilient joint portion connecting the four corners of the stationary housing portion to the corresponding four corners of the movable housing portion and a plurality of female terminals attached to each housing Each female terminal comprises a contact section and a base section joined together by an intermediate resilient section. The contact section of the female terminal is attached to the movable housing portion while the base section is attached to the stationary housing portion, thereby permitting the floating of the movable housing portion with respect to the stationary housing portion.

7 Claims, 11 Drawing Sheets

FLOATING TYPE ELECTRIC CONNECTOR

FIELD OF THE INVENTION

The present invention relates to a floating type electric connector comprising movable and stationary housing sections, and more particularly to an improvement relating to the joint between the movable and stationary housing sections.

DESCRIPTION OF THE PRIOR ART

As is well known, floating type electric connectors have been widely used. Such a floating type electric connector comprises a stationary housing which is to be fixed to a printed circuit board, a separate movable housing which is capable of moving with respect to the stationary housing, and a plurality of female terminals. The terminals are attached to the housings laterally at regular intervals, and are to be mated with a plurality of male terminals of a mating electric connector, which is fixed to another printed circuit board. Even if one printed circuit board is somewhat deviated from its prescribed position relative to the other printed circuit board, the movable connector housing can be brought to such a position that the positional deviation may be absorbed, thus permitting the mating of the male and female terminals for stable connection.

To assure that the movable housing can move with respect to the stationary housing of the floating type electric connector, a movable joint is used to connect the movable housing to the stationary housing A conventional floating type electric connector is made by forming a movable housing and a stationary housing separately, and by attaching a movable joint to these separate housings. Another conventional floating type electric connector is made by forming a movable housing and a stationary housing in an integrated form; separating these housings and finally attaching a movable joint to these separate housings. The disadvantage in these conventional connectors is that extra steps are required in forming movable and stationary housings separately or in separating movable and stationary housings and connecting the separated housings with movable joints.

Also in the hope of increasing the flexibility move of the movable housing relative to the stationary housing, the movable joint is reduced in thickness. This is liable to decrease the strength of the floating type electric connector against undesired external force, particularly against the vertically downward loading on the movable housing.

SUMMARY OF THE INVENTION

One object of the present invention is to provide a floating type electric connector structure which permits reduction of assembling steps and, accordingly improves the efficiency with which such floating type electric connectors can be manufactured.

Another object of the present invention is to provide a floating type electric connector structure which has an increased resistance to undesired external force, particularly to the vertically downward loading on the movable housing of the floating type electric connector.

To attain these objects a floating type electric connector adapted to be mounted on a circuit board, comprises a unitarily molded housing having a movable housing portion, a stationary housing portion mountable on the surface of the circuit board and surrounding the movable housing portion, and at least two resilient joints flexibly connecting the movable and stationary housing portions. The stationary housing portion surrounds the movable housing portion limiting the movement of the movable housing portion. A plurality of female terminals are provided each having a terminal mating section and a base section joined by an intermediate resilient section. The mating terminal section is mounted in the movable housing portion and the base terminal section is mounted in the stationary housing portion.

According to another preferred embodiment of the present invention, each resilient section of the terminal comprises two inverted U-shaped sections integrally connected at one end. The other end of one inverted U-shaped section being integrally connected to the solder tail section. The other end of the other inverted U-shaped section being integrally connected to the mating terminal section.

According to still another preferred embodiment of the present invention, the base section has arms extending laterally with projections on the base arms extending toward the mating terminal section and adapted to be mounted in the stationary housing portion so that the base section is mounted in the stationary housing portion. Also extending from the base section toward the movable housing portion is a support which contacts the movable housing portion when it moves a finite distance.

Other objects and advantages of the present invention will be understood from the preferred embodiment of the present invention, which is shown in accompanying drawings.

DESCRIPTION OF THE PREFERRED EMBODIMENT

Figure 1:
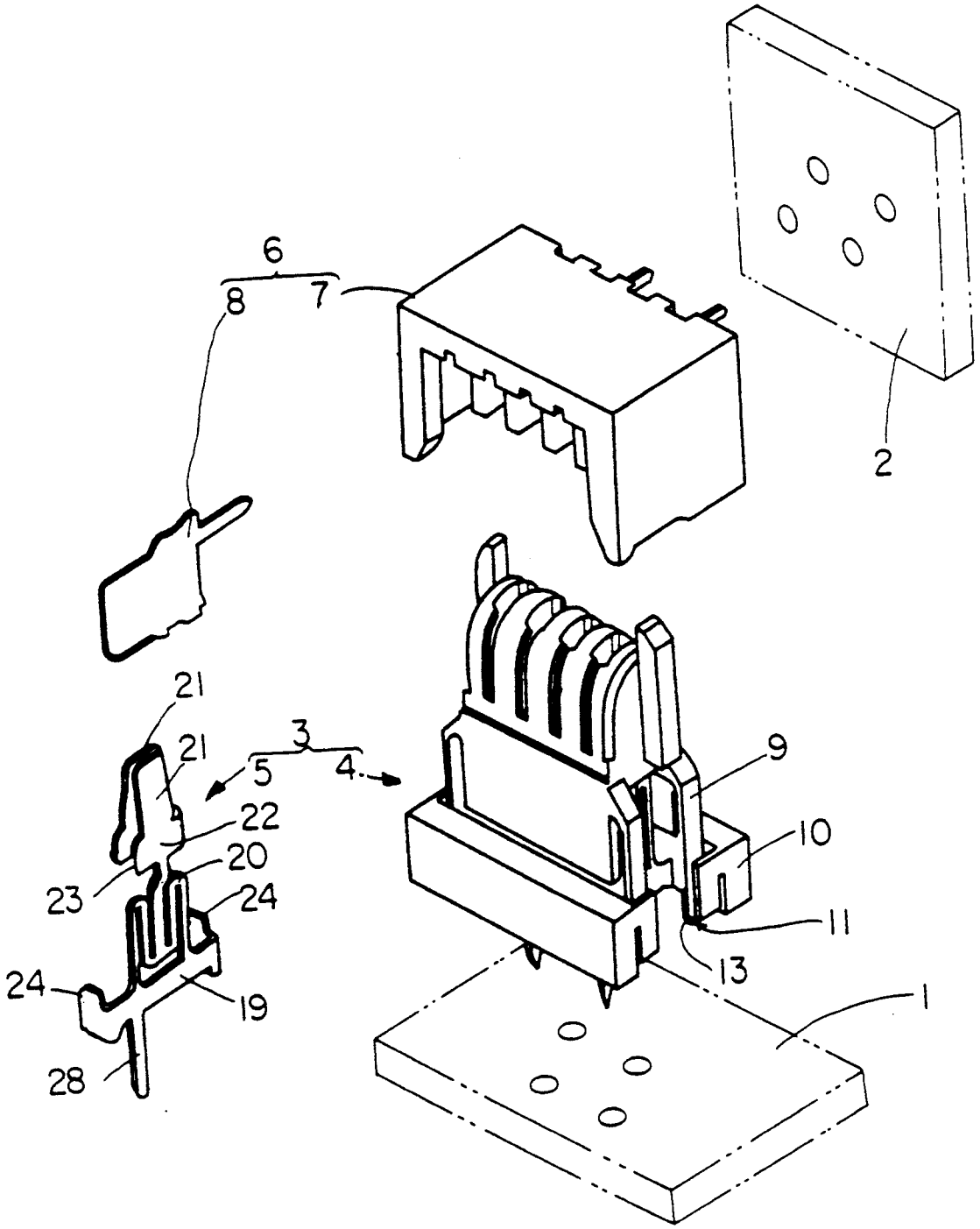
FIG. 1 is an exploded perspective view of a floating type electric connector according to one preferred embodiment of the present invention, showing two printed circuit boards (phantom lines) to be electronically connected with the aid of the floating type electric connector.
Figure 2:
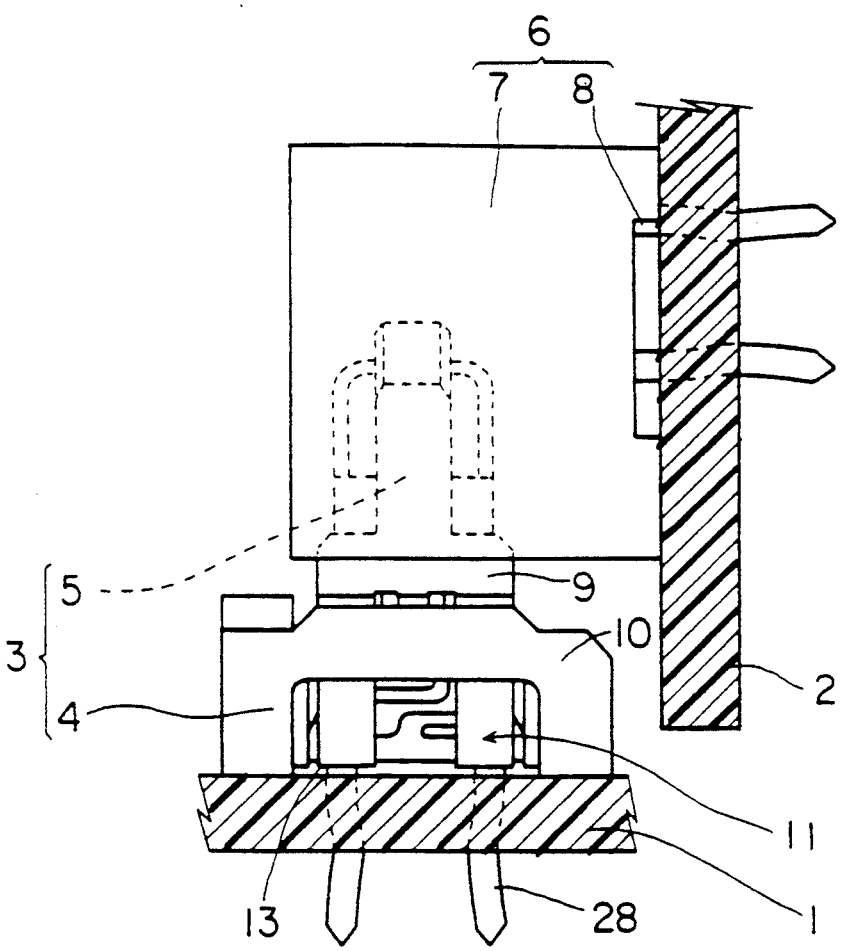
FIG. 2 shows a floating type electric connector according to another preferred embodiment of the present invention, showing two printed circuit boards connected together with the aid of the floating type electric connector.
Figure 3:
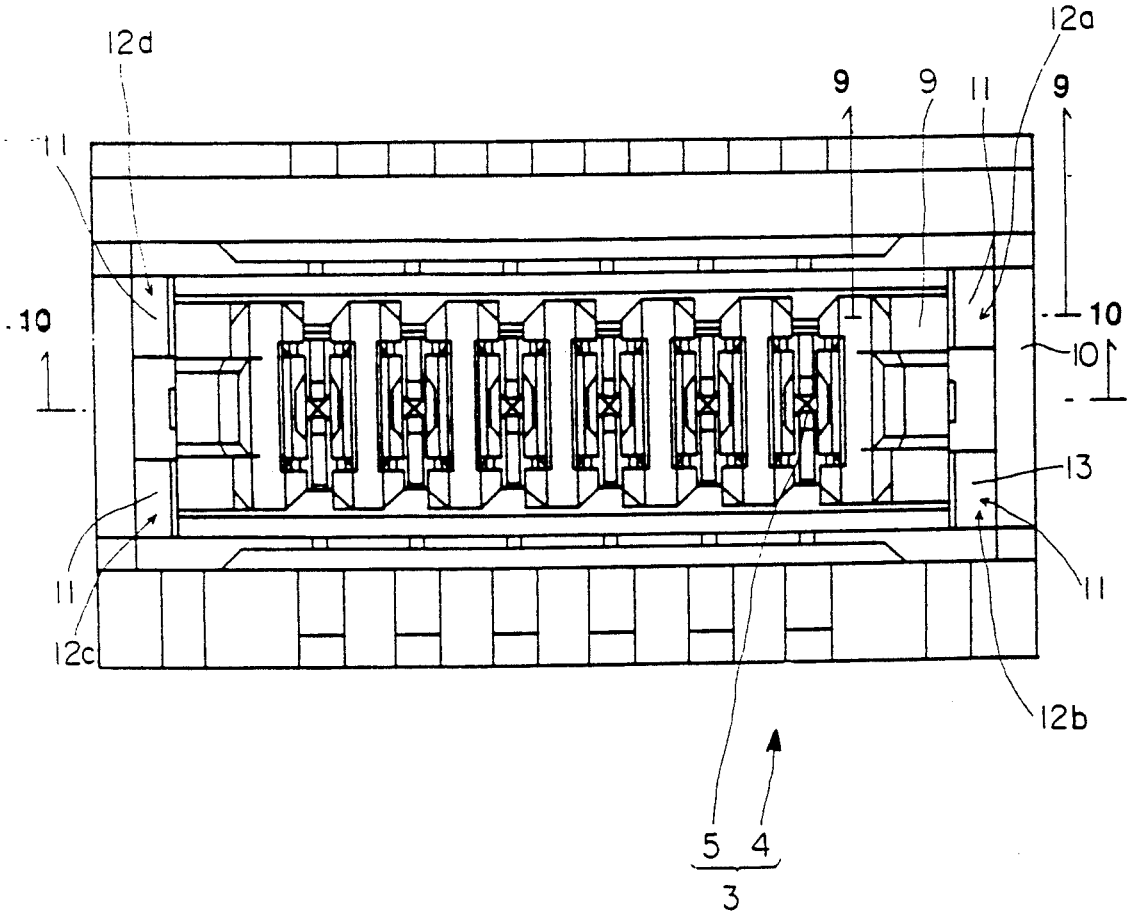
FIG. 3 is a plane view of a floating type electric connector according to the embodiment of FIG. 2.
Figure 4:
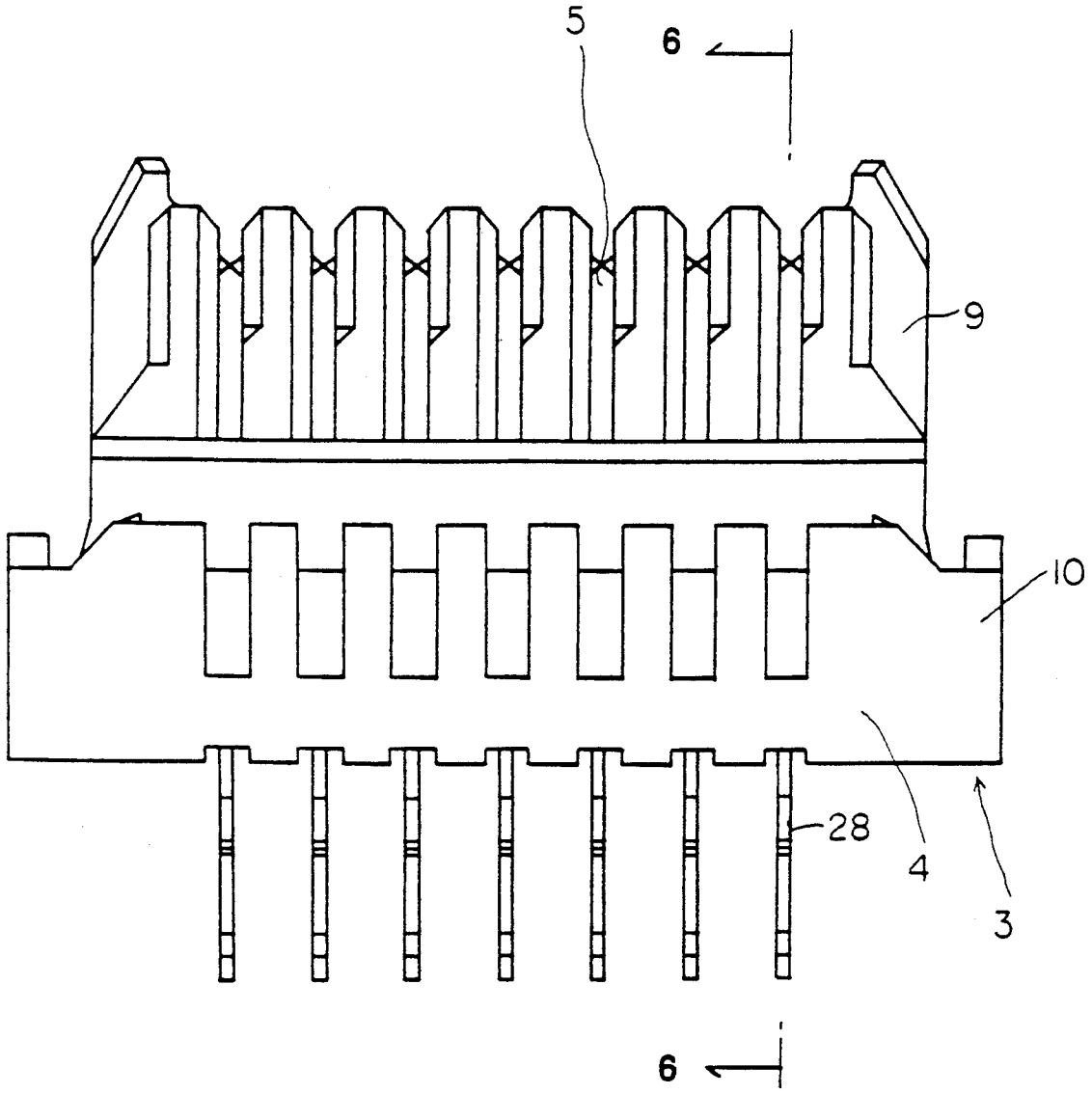
FIG. 4 is a front view of the floating type electric connector.
Figure 5:
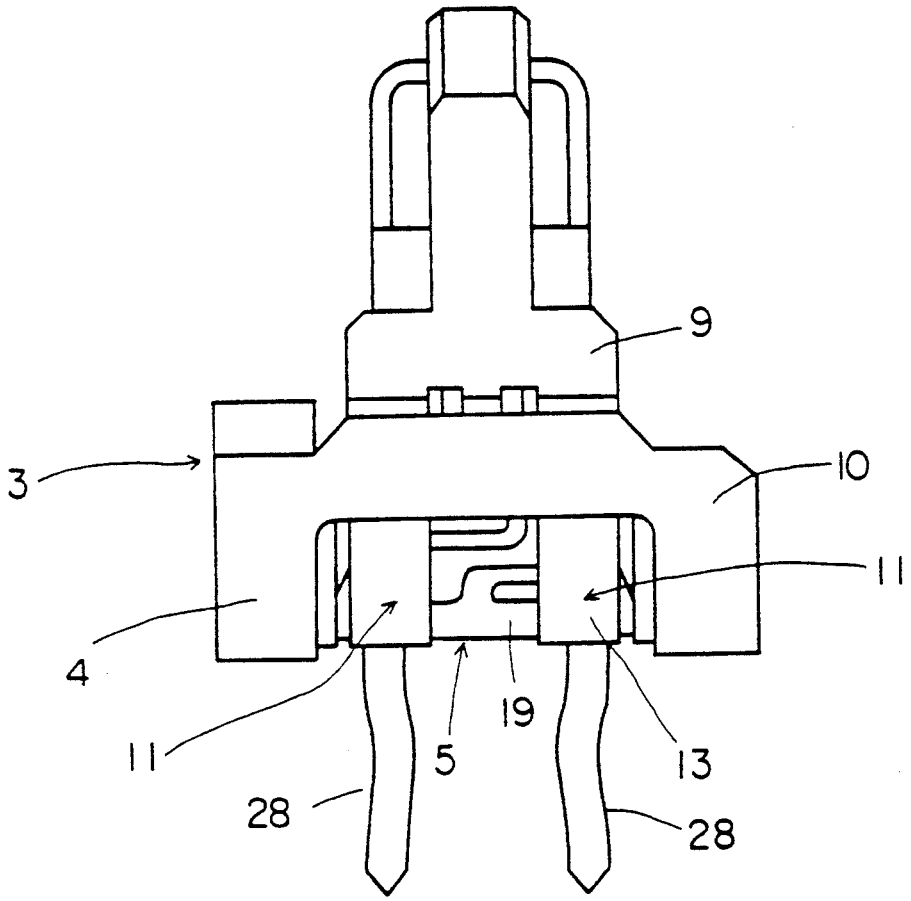
FIG. 5 is a right side view of the floating type electric connector.

FIGS. 1 and 2 show two embodiments of floating type electric connectors of the present invention. In these drawings each electric connector 3 which is to be attached to one printed circuit board 1 includes a housing 4 having a plurality of female terminals 5 laterally arranged at regular intervals. A mating electric connector 7 which is to be attached to another printed circuit board 2 includes a housing 6 having a plurality of male terminals 8 laterally arranged at regular intervals. Referring to FIG. 3 and subsequent drawings, the floating type electric connector of FIG. 2 is described in detail.

The housing 4 comprises an upper, inner movable housing portion 9 and a lower, outer stationary housing portion 10, which is to be attached to a printed circuit board. Different from a conventional floating type electric connector which includes separate movable and stationary housings, the movable housing portion 9 is so connected to the stationary housing portion 10 that the movable housing portion 9 may move relative to the stationary housing portion 10. As best seen from FIG. 3, the four corners of the inner movable housing portion 9 are connected to the corresponding four corners of the outer stationary housing portion 10 by resilient joint pieces 11 as indicated by 12*a*, 12*b*, 12*c* and 12*d*.

Figure 7:
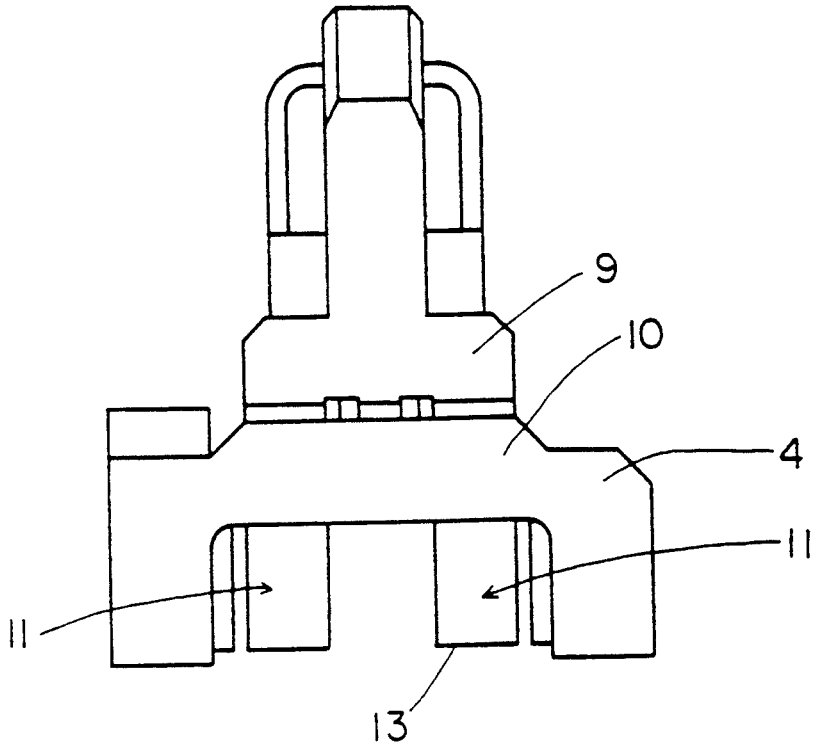
FIG. 7 is a right side view of the movable and stationary housings of the floating type electric connector prior to insertion of female terminals.
Figure 8:
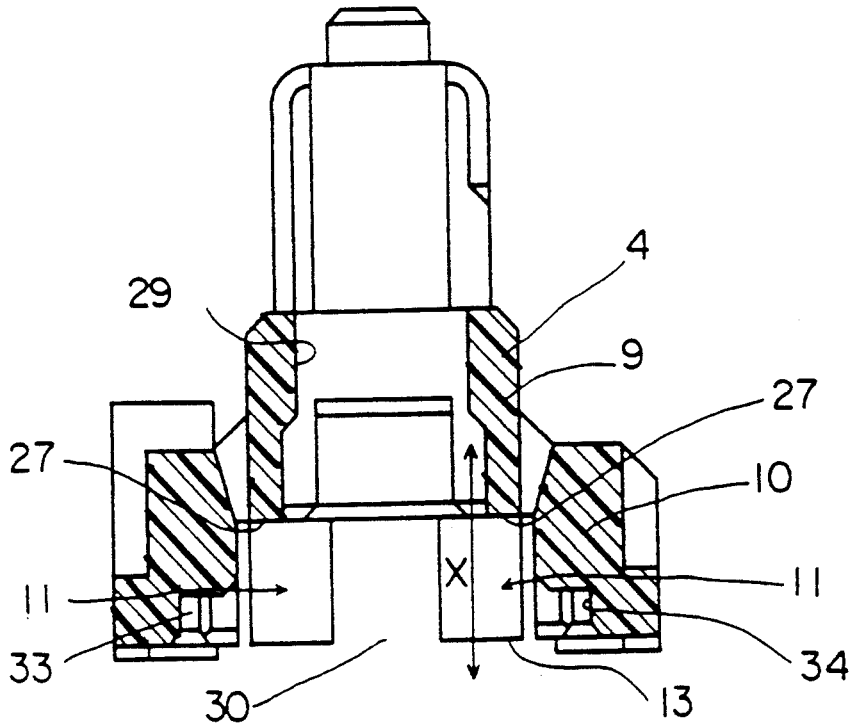
FIG. 8 is a section view of the movable and stationary housings of the floating type electric connector taken along the line 8—8 in FIG. 4 prior to insertion of female terminals.
Figure 9:
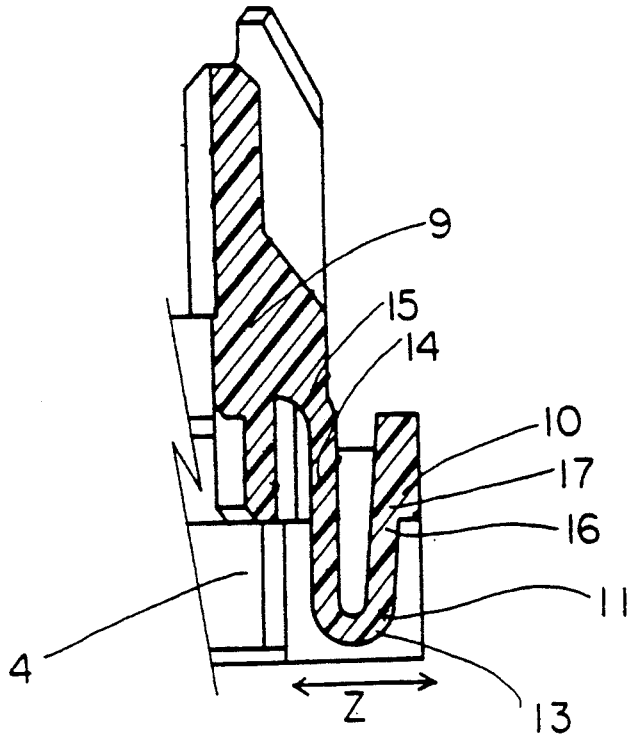
FIG. 9 is a sectional view of the fragments of the movable and stationary housings of the floating type electric connector taken along the line 9—9 in FIG. 3 prior to insertion of female terminals.
Figure 10:
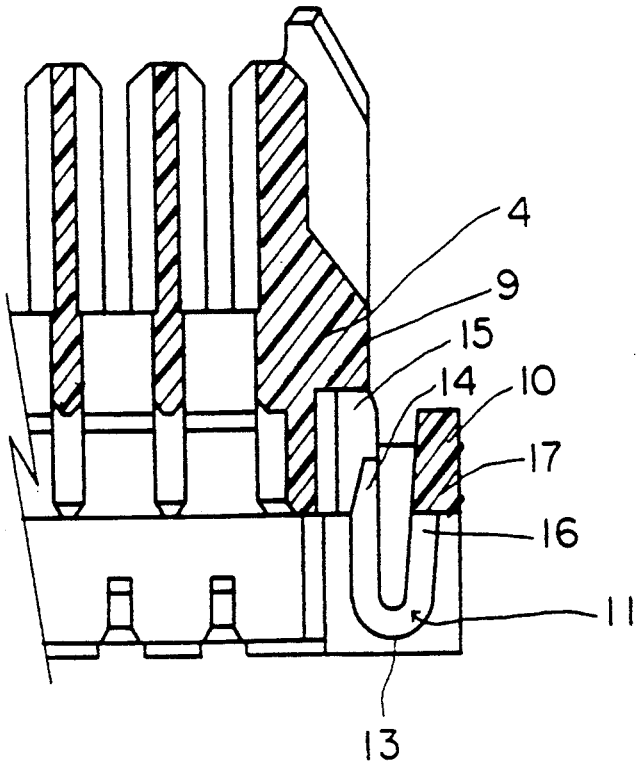
FIG. 10 is a sectional view of the fragments of the movable and stationary housings of the floating type electric connector taken along the line 10—10 in FIG. 3 prior to insertion of female terminals.

Referring to FIGS. 7 and 10, these resilient joint pieces 11 are described in detail. For the sake of simplicity the movable and stationary housing portions 9 and 10 are shown prior to insertion of female terminals 5. As seen from these drawings, each resilient joint piece at each corner is a "U"-shaped piece 13. The opposite ends 14 and 16 of the resilient joint piece 11 are integrally connected to the movable housing portion 9 at 15 and the stationary housing portion 10 at 17 respectively. These U-shaped joint pieces permit the movable housing 9 to move horizontally with respect to the stationary housing 10 in opposite horizontal directions as indicated by a double-headed arrow Z in FIG. 9 and, at the same time, move vertically with respect to the stationary housing 10 in opposite vertical directions as indicated by a double-headed arrow X in FIG. 8.

Figure 11:
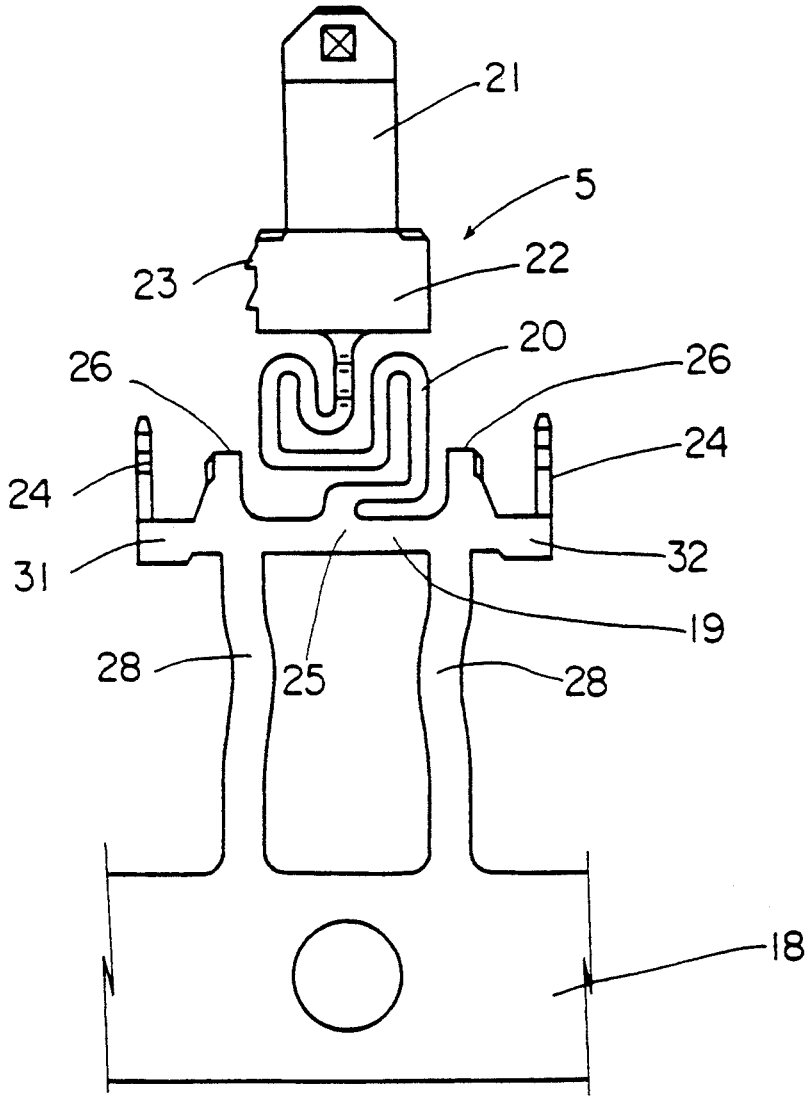
FIG. 11 is a plane view of a female terminal integrally connected to a carrier strip.

FIG. 11 shows a female terminal 5 joined to a carrier strip 18. As shown in the drawing, the female terminal 5 comprises a base section 19, an intermediate resilient section 20 extending from the center of the base section 19, and a contact piece which is composed of a lower contact section 22 integrally connected to the intermediate resilient section 20 and an upper contact section 21 consecutive to and integrally connected to the lower contact section 22.

The lower contact section 22 has sawtooth projections 23 on one side thereof, which will be held in the movable housing portion 9. The base section 19 has laterally extending arms 31, 32 upon which appear projections 24 which will skive into the stationary housing portion 10. Also, the arms 31, 32 each have a rest section 26 located between the opposite projections 24. These rest sections 26 will support the movable housing portion 9 when the moveable housing portion descends. Finally, the base section 19 has two solder tails 28 integrally connected to its bottom edge.

Figure 12:
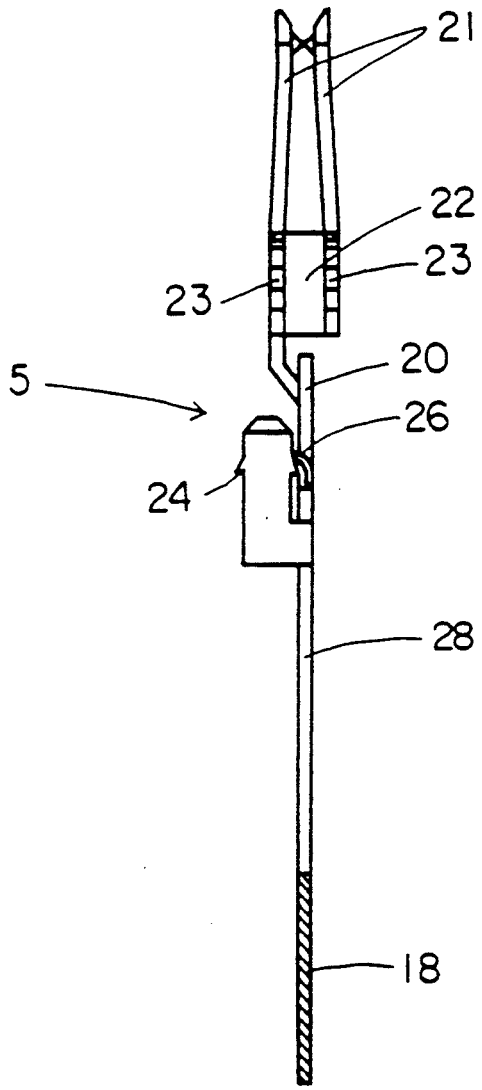
FIG. 12 is a right side view of the female terminal of FIG. 11.
Figure 13:
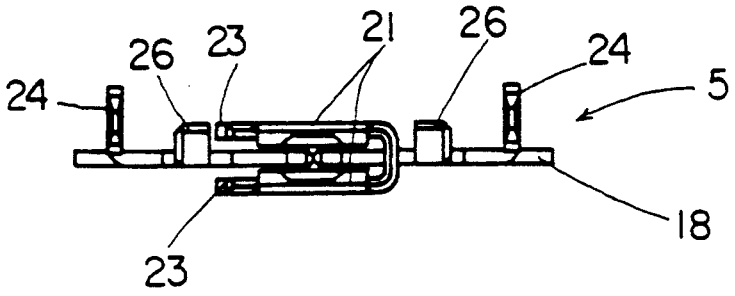
FIG. 13 is a top view of the female terminal of FIG. 11.
Figure 14:
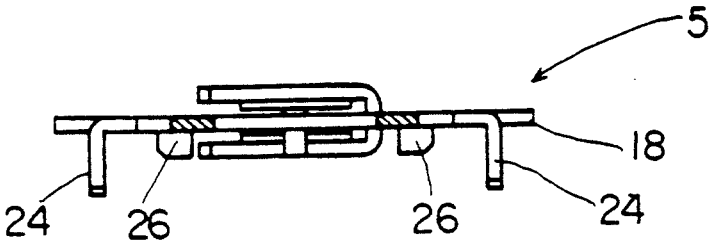
FIG. 14 is a bottom view of the female terminal of FIG. 11.
Figure 15:
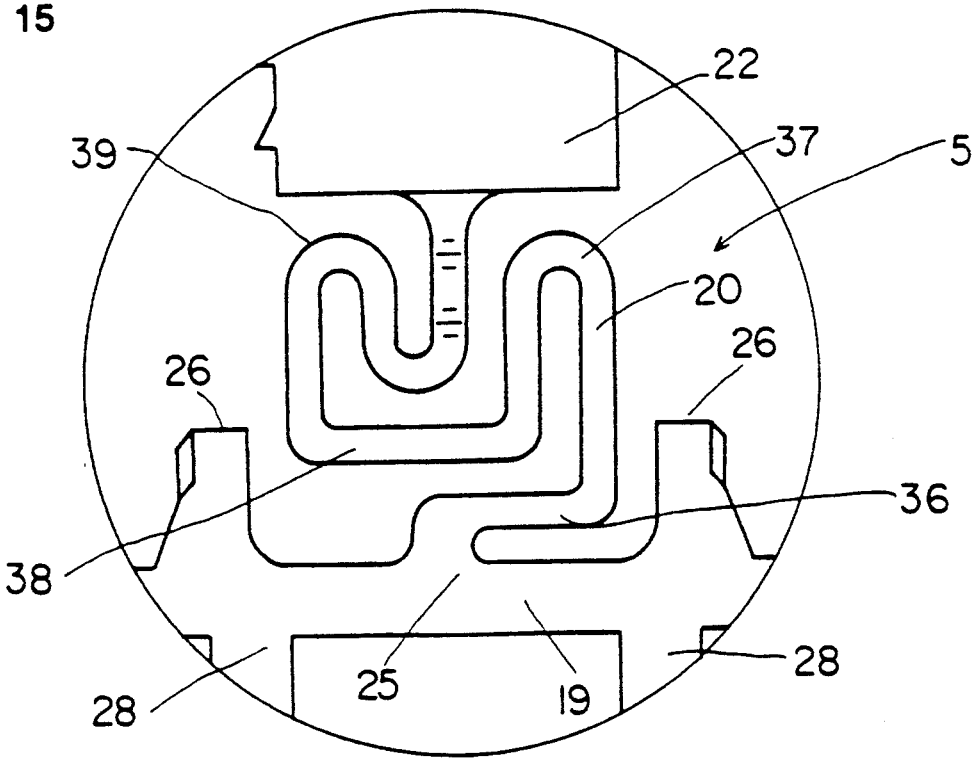
FIG. 15 is an enlarged view of the resilient joint conductor of the female terminal.

A series of female terminals are removed from the carrier strip 18 by cutting and allowing one or the other solder tail 28 on the carrier strip to remain so that when assembled the solder tails will be staggered. FIG. 12 shows a female terminal 5 integrally connected to an elongated carrier 18 as seen from the left side of the female terminal 5. As shown in this drawings, the upper contact section 21 is bifurcated, defining the contact gap, and the projections 24 are somewhat behind the plane in which the base section 19 is laid, and the projections 24 rise upward toward the contact section 21.

As seen from FIG. 12, the sawtooth projections 23 are formed on one side of each of the bifurcated pieces of the upper contact section 21. The rests 26 will function to bear the bottom 27 of the movable housing 9 when overloaded and lowered down in the direction X. This has the effect of preventing the permanent deformation of the intermediate resilient section 20. As seen from FIG. 12, the top of the rest 26 is rounded.

Figure 6:
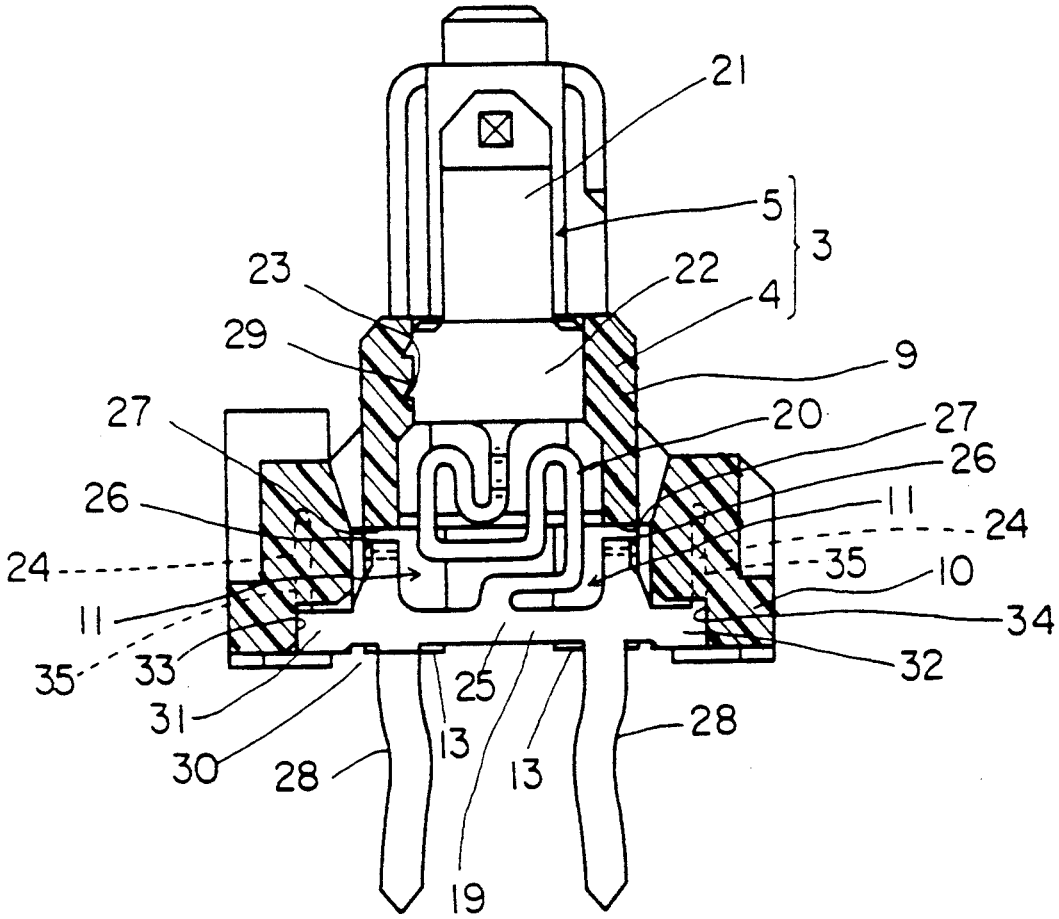
FIG. 6 is a sectional view of the floating type electric connector taken along the line 6—6 in FIG. 4.

The manner in which these female terminals 5 are attached to the movable and stationary housing portions 9 and 10 is described below. As seen from FIG. 6, the female terminal 5 is pushed in the bottom slot 30 of the stationary housing portion 20 with its contact 21 directed upward until its sawtooth projections 23 have been caught by the counter notches 29 of the movable housing, thereby connecting the female terminal 5 to the movable housing 9. In this condition the opposite base arms 31 and 32 are fitted in the opposite recesses 33 and 34 of the stationary housing 10, and at the same time, the opposite projections 24 of the base section 19 are fitted in the opposite longitudinal holes 35 of the stationary housing portion 10. Thus, the female terminal 5 is connected both to the movable and stationary housing portions 9 and 10. When all female terminals 5 are inserted into both housing portions, the movable housing portion 9 is movably connected to the stationary housing 10 via numerous female terminals 5. Specifically the movable housing portion 9 can be moved relative to the stationary housing portion 10 horizontally in the direction indicated by the double-headed arrow Z. This horizontal displacement is permitted by resilient deformation of the intermediate resilient section 20 of each female terminal 5. The displacement is allowed only to the extent allowed by the outer wall of the movable housing portion and the inner wall of the stationary housing portion. To permit such resilient deformation of the female terminal 5, the intermediate resilient section 20 comprises two inverted "U"-shaped sections 37 and 39 integrally connected to each other at one end, and the other end of one inverted "U"-shaped section 37 is integrally connected to the base section 19 whereas the other end of the other inverted "U"-shaped section 39 is integrally connected to the contact section 22 of each female terminal 5. This particular shape permits elongation of the joint distance long enough to permit the intermediate resilient section to be yieldingly deformed under a certain load and return to its original, stress-free form when the load is removed.

To make an electric connection between two printed circuit boards 1 and 2 it suffices that a floating type electric connector 3 is attached to one of these printed circuit boards 1 and 2 and that each male terminal 8 of the mating electric connector 6 of the other printed circuit board fits between the bifurcated pieces of the upper contact section 21 of each female terminal.

Even if these printed circuit boards 1 and 2 are deviated from their prescribed positions, the floating type electric connector allows its movable housing portion 9 to move relative to its stationary housing portion 10 horizontally in the direction Z both via the resilient joint pieces 11 bridging the movable and stationary housing portions 9 and 10 and the intermediate resilient section 20 of the female terminals 5 so as to absorb such deviation, making an electric connection between the printed circuit boards 1 and 2. The double floating connection provided by the resilient joint pieces 11 and the intermediate resilient sections 20 assures that the strength of the floating connection is strong enough to resist against undesired external force.

Assume that an undesired strong force is applied to the electric connector 3 upon insertion of the male terminals 8 of the mating electric connector 6 into the bifurcated pieces of the upper contact section 21 of the electric connector 3. Under these circumstances, the movable housing portion 9 may be lowered excessively. Its downward movement will be limited thereby preventing excessive deformation or overloading of the intermediate resilient section 20 by permitting the bottom 27 of the movable housing section 9 to abut against the rest sections 26 of the female terminals 5. The rest section 26 is curved as shown in FIG. 12 so that the counter force placed on the movable housing section 9 is variable.

The movable and stationary housing portions 9 and 10 and the joint piece 11 are molded as one piece. Therefore, the manufacturing cost can be substantially reduced compared with a conventional method of molding separate movable and stationary housings and connecting the separate movable and stationary housings or another conventional method of molding movable and stationary housings in an integral form, separating, and then connecting the separated movable and stationary housings.

The intermediate resilient section 20 of the female terminal 5 appearing in FIG. 1 is somewhat different from the particular shape of intermediate section 20 in FIG. 11, but it functions similarly to cause the same effect. Although the intermediate resilient section 20 of the female terminal 5 of FIG. 1 has no upper projections or rests 26 to prevent excessive descending of the movable housing portion 9 when subjected to undesired loading, it still has the effect of providing the advantages described above with respect to the structures as defined herein.

While the invention has been described in terms of two preferred embodiments, those skilled in the art will recognize that the invention can be practiced with modifications within the sprint and scope of the appended claims.

We claim:

1. A floating type electric connector adapted to be mounted on a circuit board, comprising:

a unitarily molded, housing having a movable housing portion and a stationary housing portion mountable on the surface of the circuit board, and at least two resilient joints flexibly connecting the movable and stationary housing portions, said stationary housing portion surrounding the movable housing portion, thus limiting the movement of said movable housing portion; and a plurality of female terminals each having a terminal mating section and a base section jointed by an intermediate resilient section, said mating terminal section being mounted in said movable housing portion and said base terminal section being mounted in said stationary housing portion.

2. A floating type electrical connector according to claim 1 wherein said stationary and movable housing portions having ends and said resilient joints are attached to opposite ends of said movable and stationary housing portions.

3. A floating type electrical connector according to claim 2 wherein each of said resilient joints is a U-shaped piece.

4. A floating type electrical connector according to claim 3 wherein the intermediate resilient section of said terminal comprises two inverted U-shaped sections integrally connected at one end of each inverted U-shaped section, the other end of one inverted U-shaped section being integrally connected to said base section and the other end of the other inverted U-shaped section being integrally connected to said terminal mating section.

5. A floating type electric connector according to claim 1 wherein said base section has arms extending laterally with projections on said base arms extending toward the mating terminal section and adapted to be mounted in the stationary housing portion so that the base section is mounted in the stationary housing portion.

6. A floating type electric connector according to claim 5 wherein said base section has a rest section extending toward the movable housing portion adapted to support the moveable housing portion when said movable housing portion moves toward said rest sections a finite distance.

7. A floating type electric connector according to claim 6 wherein said rest section is curved so that the rest section can exert a variable counter force against the movable housing portion after it moves a finite distance.

* * * * *